US011108138B2

(12) United States Patent
Chu et al.

(10) Patent No.: US 11,108,138 B2
(45) Date of Patent: Aug. 31, 2021

(54) ANTENNA SYSTEM AND ASSEMBLY METHOD THEREOF, AND BASE-STATION ARRAY ANTENNA

(71) Applicant: AAC Technologies Pte. Ltd., Singapore (SG)

(72) Inventors: Qingchen Chu, Shenzhen (CN); Li Han, Shenzhen (CN); Yuehua Yue, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/996,930

(22) Filed: Aug. 19, 2020

(65) Prior Publication Data

US 2020/0411968 A1 Dec. 31, 2020

Related U.S. Application Data

(63) Continuation of application No. PCT/CN2019/094090, filed on Jun. 30, 2019.

(51) Int. Cl.
*H01Q 1/24* (2006.01)

(52) U.S. Cl.
CPC ..... *H01Q 1/246* (2013.01)

(58) Field of Classification Search
CPC ..... H01Q 1/38; H01Q 9/0457; H01Q 1/1207; H01Q 1/246; H01Q 21/00
See application file for complete search history.

(56) References Cited

FOREIGN PATENT DOCUMENTS

CN 102394353 A * 3/2012

* cited by examiner

*Primary Examiner* — Keith Ferguson
(74) *Attorney, Agent, or Firm* — W&G Law Group LLP

(57) ABSTRACT

An antenna system includes: a radiating sheet provided with an elastic first fixing portion; an insulating bracket including a bracket body, and mounting portions, a second fixing portion and a first assembling portion; coupling circuit sheets, each of which is provided with a coupling circuit at a single side thereof and fixed in a slide rail of the mounting portion in such a manner that a feeding pin at a bottom of the coupling circuit sheet extends out of the one mounting portion; and a feeding network circuit board. In the antenna system and an assembly method thereof, and a base station array antenna, there is various one-time fixing structures, which makes the assembly to be simple and efficient, and there are few feeding welding points, which is suitable for automatic production.

10 Claims, 7 Drawing Sheets

ANTENNA SYSTEM AND ASSEMBLY METHOD THEREOF, AND BASE-STATION ARRAY ANTENNA

TECHNICAL FIELD

The present invention relates to the field of mobile communication technology and, in particular, to an antenna system and an assembly method thereof, and a base-station array antenna.

BACKGROUND

With our demand for high transmission rates and high stability of communication quality, and continuous development of mobile communication technology, newly popularized fourth-generation (4G) communication can no longer fully meet our demand for large throughput data volume, and fifth generation (5G) communication has gradually become a research hotspot in the communication industry.

The most important features of 5G includes big data, public connection and scene experience. The big data means large data volume, high data rate, and mainly data services, and provides support for the development of mobile internet. The public connection means that a large number of Internet of Things terminal users access, to provide an ability to connect everything. The scene experience is to provide better user experience corresponding to different scenes. During application, mobile communication data and Internet of Things communication data have experienced explosive growth of orders of magnitude.

As one of key technologies of 5G, an array antenna technology can greatly improve a processing capacity of a network system by arranging an antenna matrix with a scale of dozens of or hundreds of antennas on a terminal of a base-station. Therefore, with the deployment of mobile communication networks towards refinement and deep coverage base-station integration, compared with current 3G and 4G mobile communication technologies, a next-generation mobile communication technology 5G that is about to be commercialized adopts a large-scale array antenna with a higher application frequency band and more ports, so the communication system puts forward higher requirements for miniaturization, lightweight and low cost of the antenna.

Most base-station antennas adopt metal die-casting or plate metal antennas or integrated circuit antennas. When adopting the metal die-casting or plate metal antennas, a weight of a die-casted antenna is too large. When adopting the integrated circuit antenna, assembly and production of the integrated circuit antenna is complicated, precision after the assembly is not high, so that it is not suitable for automatic production, and there are as many as a dozen feeding welding points, leading a poor consistency between the antenna systems.

There are assembly errors in a structure design of the antenna system, and there are also manufacturing accuracy errors, so the consistency of the produced antenna system is poor. However, in the method of using technologies such as new technical plastic plating or LDS to make the antenna system, since there is no systematic reliability verification method and cost is relatively high, it is still not adopted in the 5G base-station layout of equipment vendors.

Therefore, designs of the antenna systems still need to be improved.

SUMMARY

Embodiments of the present invention provide an antenna system, a base-station array antenna, and an assembly method of the antenna system, which have multiple kinds of one-time fixing structures that are simple and efficiently mounted, and fewer feeding welding points, are suitable for automatic production and have high assembly precision.

An antenna system includes a radiating sheet provided with at least one first fixing portion that is elastic; an insulating bracket including a bracket body, and a plurality of mounting portions, at least one second fixing portion and at least one first assembling portion that are provided on the bracket body; a plurality of coupling circuit sheets; and a feeding network circuit board including at least one second assembling portion and a feeding network. Each of the plurality of coupling circuit sheets is provided with a coupling circuit at a single side thereof and is fixed in a slide rail of one mounting portion of the plurality of mounting portions in such a manner that a feeding pin located at a bottom of the coupling circuit sheet extends out of the one mounting portion. The at least one second fixing portion is provided at a top of the bracket body, and the at least one first assembling portion is provided at a bottom of the bracket body. The at least one first fixing portion and the at least one second fixing portion cooperate with each other in such a manner that the radiating sheet is mounted to the insulating bracket, the at least one second assembling portion and the at least one first assembling portion fixedly cooperate with each other in such a manner that the insulating bracket is mounted to the feeding network circuit board, and the feeding network is electrically connected to the feeding pin to feed a signal.

As an improvement, the bracket body is an annular bracket body, the plurality of the mounting portions is evenly distributed along a circumference of the bracket body, the top of the bracket body extends upward to form two pairs of top connecting tabs, the bottom of the bracket body extends downward to form two pairs of bottom connecting tabs, the at least one second fixing portion includes four bosses, and each of the four bosses is disposed on one top connecting tab of the two pairs of top connecting tabs; the at least one first assembling portion includes a first positioning post, a second positioning post, a first snap joint and a second snap joint, the first positioning post and the second positioning post are arranged on a group of opposite bottom connecting tabs of the two pairs of bottom connecting tabs, respectively, and the first snap joint and the second snap joint are arranged on another group of opposite bottom connecting tabs of the two pairs of bottom connecting tabs, respectively.

As an improvement, the at least one first fixing portion includes four first fixing portions corresponding to the four bosses, each of the four first fixing portions includes a first rectangular spring corner and a second rectangular spring corner, and each of the four bosses is inserted between the first rectangular spring corner and the second rectangular spring corner that are opposite to each other in such a manner that each of the first rectangular spring corner and the second rectangular spring corner generates an elastic deformation force and is snap jointed and fixed to one of the four bosses.

As an improvement, the at least one first fixing portion includes four first fixing portions corresponding to the four bosses, each of the four first fixing portions includes a plurality of acute-angled spring corners, and each of the four bosses is inserted between the plurality of the acute-angled spring corners of one of the four first fixing portions in such a manner that the plurality of the acute-angled spring corners generates an elastic deformation force and is snap jointed and fixed to one of the four bosses.

As an improvement, the at least one second assembling portion includes a first positioning hole, a second positioning hole, a first snap groove and a second snap groove that are provided in the feeding network circuit board; and in an assembly process, the first positioning post is pre-positioned in the first positioning hole, the second positioning post is pre-positioned in the second positioning hole, and the insulating bracket is pressed in such a manner that the first snap joint is connected in the first snap groove and the second snap joint is connected in the second snap groove.

As an improvement, each of the plurality of coupling circuit sheets is a PCB circuit board that is coated with copper on a single surface thereof; each of the plurality of coupling circuit sheets includes a base layer and a circuit layer, and the coupling circuit is provided in the circuit layer; and each of the plurality of coupling circuit sheets is provided with a fixing hole at a side thereof close to the feeding pin; the plurality of mounting portions includes four mounting portions, the slide rail includes a first slide rail and a second slide rail, each of the plurality of mounting portions includes a body, the first slide rail and the second slide rail are formed on two sides of the body, the body is provided with an oblique boss on a side of the body where the slide rail is provided, the body is provided with a reinforcing rib on another side thereof, and each of the plurality of coupling circuit sheets is capable of sliding into the first slide rail and the second slide rail of one mounting portion of the four mounting portions until the oblique boss of the one mounting portion slides into the fixing hole of the coupling circuit sheet.

As an improvement, the plurality of coupling circuit sheets includes four coupling circuit sheets, four polarization power division lines are provided on the feeding network circuit board, a polarization direction of each of the four polarization power division lines is of +45 degrees or −45 degrees, and connection terminals of the four polarization power division lines are respectively welded to feeding pins of the four coupling circuit sheets.

As an improvement, the insulating bracket is formed into one piece by a plastic injection molding process, and the radiating sheet is a square or circular metal sheet and has a thickness smaller than 0.2 mm.

A base station array antenna includes a feeding network circuit board and a plurality of antenna systems welded on the feeding network circuit board. each of the plurality of antenna systems includes: a radiating sheet provided with at least one first fixing portion that is elastic; an insulating bracket including a bracket body, and a plurality of mounting portions, at least one second fixing portion and at least one first assembling portion that are provided on the bracket body; and a plurality of coupling circuit sheets. The at least one second fixing portion is provided at a top of the bracket body, and the at least one first assembling portion is provided at a bottom of the bracket body. Each of the plurality of coupling circuit sheets is provided with a coupling circuit at a single side thereof and is fixed in a slide rail of one mounting portion of the plurality of mounting portions in such a manner that a feeding pin located at a bottom of the coupling circuit sheet extends out of the one mounting portion. Each of the plurality of coupling circuit sheets is provided with a coupling circuit at a single side thereof and is fixed in a slide rail of one mounting portion of the plurality of mounting portions in such a manner that a feeding pin located at a bottom of the coupling circuit sheet extends out of the one mounting portion. The feeding network circuit board includes at least one second assembling portion and a feeding network, the at least one first fixing portion and the at least one second fixing portion cooperate with each other in such a manner that the radiating sheet is mounted to the insulating bracket, the at least one second assembling portion and the at least one first assembling portion fixedly cooperate with each other in such a manner that the insulating bracket is mounted to the feeding network circuit board, and the feeding network is electrically connected to the feeding pin to feed a signal.

An assembling method of an antenna system includes:

sliding each of a plurality of coupling circuit sheets along a slide rail into a mounting portion of an insulating bracket, and fastening the coupling circuit sheet to the mounting portion in such a manner that a feeding pin located at a bottom of the coupling circuit sheet extends out of the mounting portion;

mounting the insulating bracket to a feeding network circuit board by fixed cooperation between a first assembling portion of the feeding network circuit board and a second assembling portion located at a bottom of the insulating bracket;

welding coupling circuits of the plurality of the coupling circuit sheets and a feeding network of the feeding network circuit board through feeding pins of the plurality of coupling circuit sheets, to feed signals; and mounting a radiating sheet to the insulating bracket by cooperation between a first fixing portion of the radiating sheet and a second fixing portion arranged at a top of the insulating bracket.

The beneficial effect of the implementation of the present invention lies in: the antenna system, the base-station array antenna, and the assembly method of the antenna system of the present embodiment, the feeding structure adopts the coupling circuit sheets of small-sized circuit boards having the same structure, to reduce the weight of each antenna system. Moreover, the antenna system has various one-time fixing structures, for example, the first fixing portion of the radiating sheet can be assembled with the second fixing portion on the top of the insulating bracket at one time, and in specific implementation, the first fixing portion may be rectangular or a plurality of sawtooth spring corners, and it may be directly plug-connected with the second fixing portion of the insulating bracket; as another example, the second assembling portion of the feeding network circuit board and the first assembling portion of the insulating bracket are also one-time fixing structures that can be completely assembled just by one operation, so that the assembly is simple in order to improve the assembly efficiency of the antenna system.

The antenna system, the base-station array antenna, and the assembly method of the antenna system of the present embodiment, each of the coupling circuit sheets is stably supported on the insulating bracket through the corresponding mounting portion and then connected to the feeding network circuit board at one operation, such that the subsequent welding operation has a better effect in order to ensure product stability; moreover, the feeding welding points are only used to connect the coupling circuit sheet, and there are few feeding welding points. The antenna system, the base-station array antenna, and the assembly method of the antenna system of the present embodiment, the plurality of the mounting portions are evenly distributed on the bracket body along the circumference of the bracket body to obtain better polarization performance. The antenna system of the present embodiment can be pre-installed on the feeding network circuit board stably through the first assembling portion being fitted to the second assembling portion, such that it is suitable for subsequent automated production and processing, and the assembly accuracy is relatively high.

BRIEF DESCRIPTION OF DRAWINGS

One or more embodiments are exemplarily illustrated by images in the corresponding drawings, and these exemplary descriptions do not constitute limitations on the embodiments. Elements with the same reference numerals in the accompany drawings are represented as similar elements. Unless otherwise stated, the images in the accompany drawings do not constitute a scale limitation.

DESCRIPTION OF EMBODIMENTS

Figure 1:
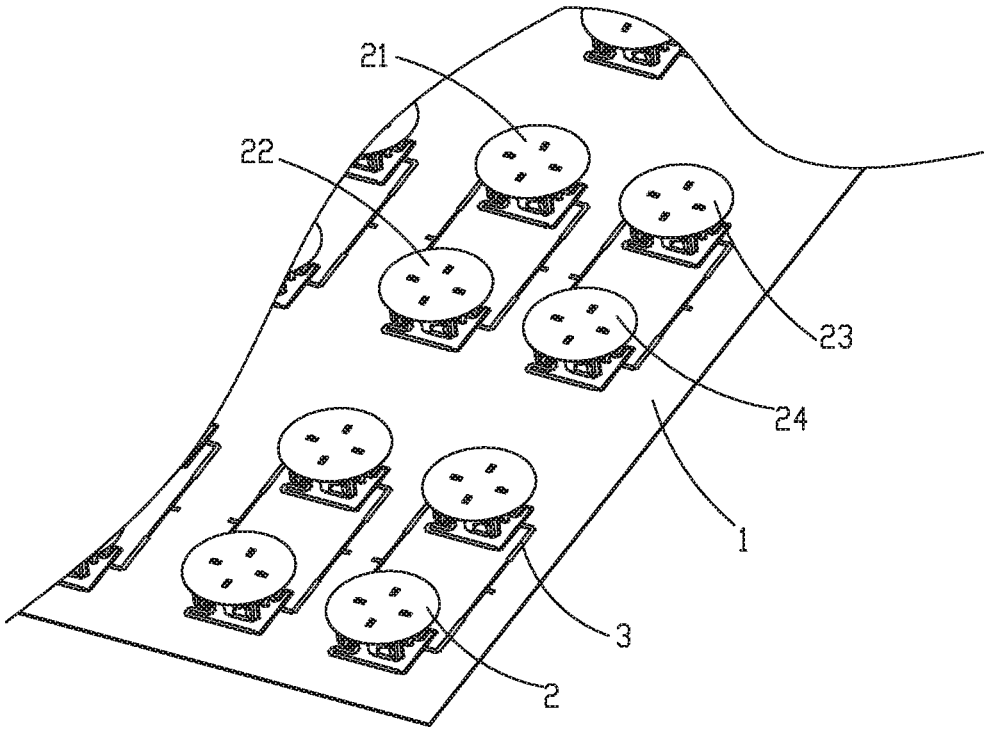
FIG. 1 is a schematic diagram of a base-station array antenna.

In order to make technical solutions of the present invention clearer, the present invention will be described in further detail with reference to the accompanying drawings and embodiments. It should be understood that the specific embodiments described herein are only used to explain the present invention and are not used to limit the present invention.

It should be noted that if there are directional indications (such as up, down, left, right, front, back . . . ) in the embodiments of the present invention, then the directional indications are only used to explain relative positional relationship, movement, etc. of various components under a specific posture (as shown in the drawings), if the specific posture changes, the directional indications also change accordingly.

In addition, if there are descriptions related to "first", "second", etc. in the present invention are for descriptive purposes only and cannot be understood as indicating or implying their relative importance or implicitly indicating the number of technical features indicated. Thus, features defined as "first" and "second" may include at least one of the features explicitly or implicitly. In addition, the technical solutions provided by the various embodiments can be combined with each other, but they must be based on the ability of those skilled in the art to realize. When the combination of the technical solutions contradicts or cannot be achieved, it should be considered that the combination of such technical solutions does not exist, nor within the protection scope claimed by the present invention.

Figure 2:
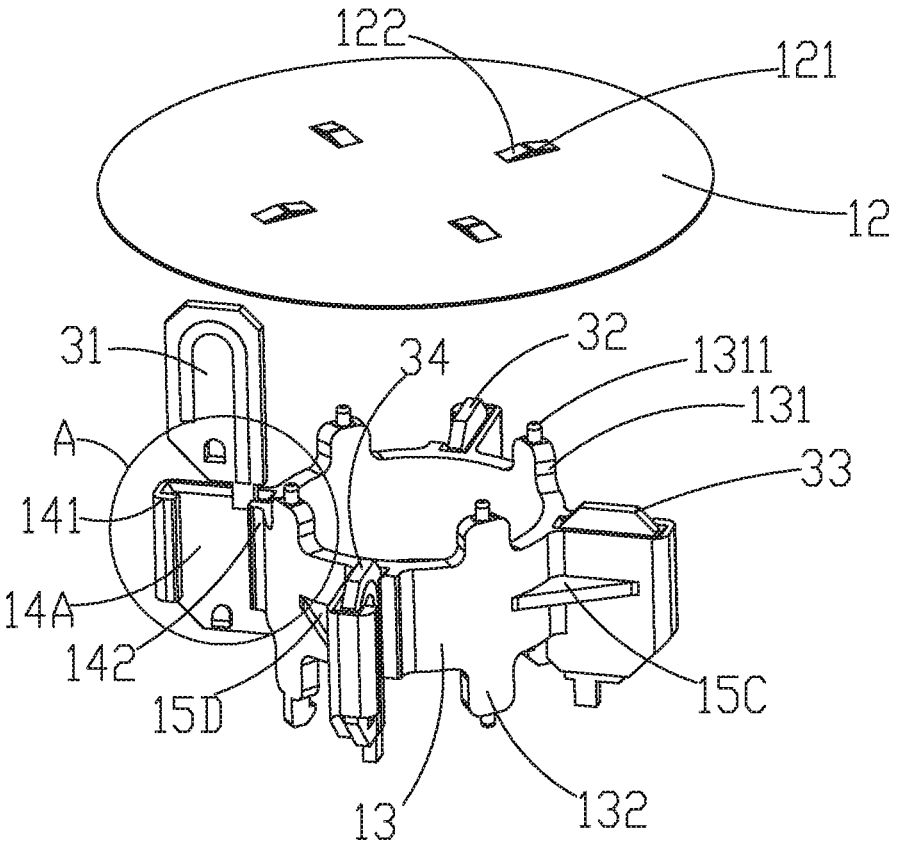
FIG. 2 is a perspective exploded schematic diagram of an antenna system.

Referring to FIG. 1 and FIG. 2, the present invention relates to an antenna system, an array antenna using the antenna system, and an assembly method of the antenna system. The array antenna is formed by welding a plurality of antenna systems 2 to a feeding network circuit board 1, and it is suitable for 5G large-scale array antennas.

In an embodiment, each antenna system includes a radiating sheet 12, an insulating bracket 13, and a plurality of coupling circuit sheets. In the antenna system, the base-station array antenna, and the assembly method of the antenna system, the feeding structure adopts the coupling circuit sheet of a small-sized circuit board having the same structure, to reduce the weight of each antenna system and improve signal feeding quality.

The radiating sheet 10 is installed by directly and efficiently plug-connecting an easy-operation one-time elastic snap joint with a second fixing portion of the insulating bracket 13, so the assembly is convenient and efficient. The coupling circuit sheet is first fixed in a slide rail of a mounting portion of the insulating bracket 13 and then welded to the feeding network circuit board 1, and feeding welding points are only used to connect the coupling circuit sheet, so that there are few feeding welding points. The mounting portions are evenly distributed on a bracket body along a circumference of the bracket body in order to obtain better antenna polarization performance. The antenna system can quickly and stably achieve pre-installation through cooperating between a first assembling portion and a second assembling portion provided on the feeding network circuit board 1, which can quickly and steadily realize pre-installation of the insulating bracket 13 at one time, so as to facilitate subsequent production processes of welding and assembling the radiating sheet.

The antenna system of the array antenna is provided as the insulating bracket 13 formed into one piece by plastic injection molding, a plurality of the coupling circuit sheets are fixedly mounted to an outer slide rail of the insulating bracket 13, and a polarization direction of each coupling circuit sheet is +45 degrees or −45 degrees. The feeding network circuit board 1 is provided with four polarization power division lines, a polarization direction of the four polarization power division lines is +45 degrees or −45 degrees, and connection terminals of the four polarization power division lines are respectively connected to feeding pins of corresponding coupling circuit sheets by welding, which ensures features of multi-polarization, multi-band, large power capacity, strong array anti-interference ability of the antenna system.

Referring to FIG. 1, the present embodiment relates to a base-station array antenna and an antenna system used by the base-station array antenna.

As shown in FIG. 1, the base-station array antenna includes the feeding network circuit board 1 and the plurality of the antenna systems 2 welded on the feeding network circuit board 1, such as an antenna system 21, an antenna system 22, an antenna system 23 and an antenna system 24 shown in FIG. 1. The feeding network circuit board 1 includes a feeding network 3. The feeding network 3 is provided with four polarization power division lines configured to be electrically connected to the to the coupling circuit sheets corresponding to each antenna system, and when the antenna is integrated, the two antenna systems are connected in parallel to the feeding network 3. As shown in FIG. 1, for example, the antenna system 21 and the antenna system 22 are connected in parallel to the feeding network 3. The antenna system 23 and the antenna system 24 are connected in parallel to the feeding network 3.

Figure 5:
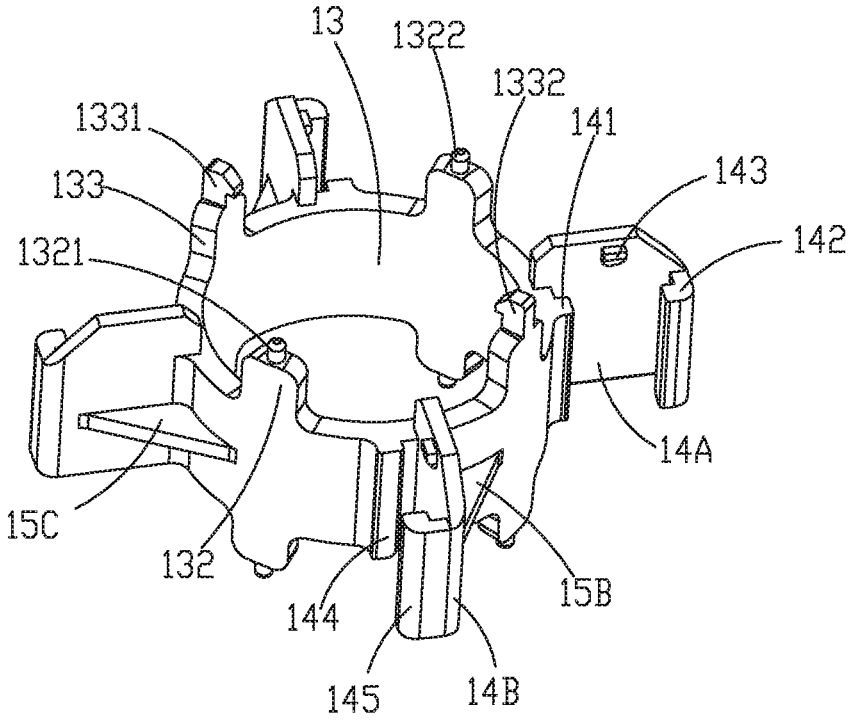
FIG. 5 is schematic diagram of a bottom of an insulating bracket of an antenna system.

Referring to FIG. 2 and FIG. 5 in combination, each antenna system 2 includes a radiating sheet 12, an insulating bracket 13, a plurality of coupling circuit sheets, and a feeding network circuit board 1. In an embodiment, the four coupling circuit sheets include a first coupling circuit sheet 31, a second coupling circuit sheet 32, a third coupling circuit sheet 33, and a fourth coupling circuit sheet 34. The following description is based on the first coupling circuit sheet 31, and other coupling circuit sheets have a same structure.

The insulating bracket 13 includes a bracket body, and a plurality of mounting portions, a second fixing portion, and a first assembling portion that are provided on the bracket body. The second fixing portion is provided at a top of the bracket body, and the first assembling portion is provided at a bottom of the bracket body. In an embodiment, the number of the mounting portions is four, and the four mounting portions include a first mounting portion 14A, a second mounting portion 14B, a third mounting portion 14C, and a fourth mounting portion 14D. The following is described based on the first mounting portion 14A, and the other mounting portions have a same structure.

The bracket body of the insulating bracket 13 is an annular bracket body. The mounting portions are evenly distributed along a circumference of the bracket body. The top of the bracket body extends upward to form two pairs of top connecting tabs 131. The bottom of the bracket body extends downward to form two pairs of bottom connecting tabs including a first pair of bottom connecting tabs 132 and a second pair of bottom connecting tabs 133.

The feeding network circuit board 1 is provided, corresponding to each antenna system 2, with second assembling portions cooperating with the first assembling portions. The second assembling portions include a first positioning hole, a second positioning hole, a first snap groove and a second snap groove that are provided in the feeding network circuit board 1. The first positioning hole, the second positioning hole, the first snap groove and the second snap groove are commonly used structures in the field of mechanical structures, so they are not marked in the drawings.

Figure 3:
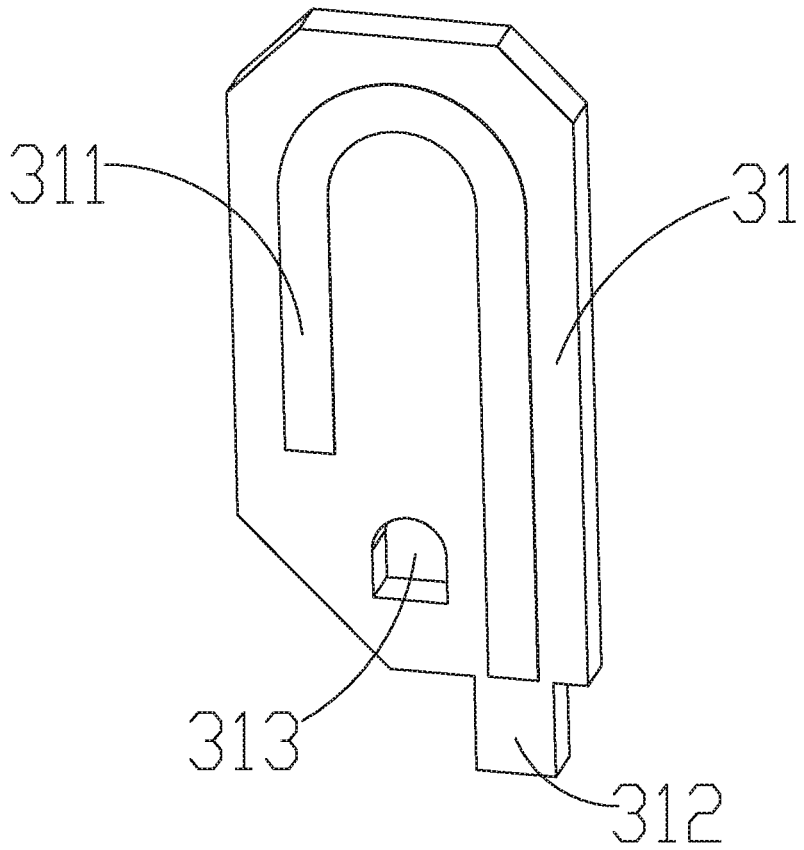
FIG. 3 is an enlarged schematic diagram of a coupling circuit sheet of an antenna system.

As shown in FIG. 3, in an embodiment, in order to reduce the weight of each antenna system 2 and improve the signal feeding quality, the coupling circuit sheet is a PCB circuit board that is coated with copper on a single surface thereof, and the coupling circuit sheet includes a base layer and a circuit layer. A coupling circuit is provided in the circuit layer, and the coupling circuit sheet is provided with a fixing hole at a side thereof close to the feeding pin. For example, the first coupling circuit sheet 31 includes a base layer 31 and a circuit layer, and a coupling circuit 311 is disposed in the circuit layer. The first coupling circuit sheet 31 is provided with a feeding pin 312 at one end and provided with a fixing hole 313 at a side thereof close to the feeding pin 312.

The feeding network circuit board 1 is provided with four polarization power division lines corresponding to each antenna system. Connection terminals of the four polarization power division lines are respectively welded to the feeding pins 312 of the coupling circuit sheets in order to realize the feeding connection. In an embodiment, a polarization direction of one of the four polarization power division lines is +45 degrees or −45 degrees.

Referring to FIG. 5 in combination, a structure of the antenna system is introduced as follows.

The antenna system 2 includes a radiating sheet 12, an insulating bracket 13, and a plurality of coupling circuit sheets. In an embodiment, the four coupling circuit sheets include a first coupling circuit sheet 31, a second coupling circuit sheet 32, a third coupling circuit sheet 33, and a fourth coupling circuit sheet 34. The following is described taking the first coupling circuit sheet 31 as an example.

The radiating sheet 12 is provided with an elastic first fixing portion.

The second fixing portions includes four bosses, and each of the four bosses is respectively disposed on a corresponding top connecting tab 131, e.g., a boss 1311.

The first assembling portions include a first positioning post 1321, a second positioning post 1322, a first snap joint 1331 and a second snap joint 1332. The first positioning post and the second positioning post are disposed on a group of opposite bottom connecting tabs 132, and the first snap joint 1331 and the second snap joint 1332 are disposed on another group of opposite bottom connecting tabs 133.

The coupling circuit is provided at a single side of each coupling circuit sheet, each coupling circuit sheet is fixed in the slide rail of the corresponding mounting portion, and the feeding pin located at the bottom of the coupling circuit sheet extends out of the mounting portion. For example, the first coupling circuit sheet 31 is provided with the coupling circuit 311 at a single side thereof, the first coupling circuit sheet 31 is fixed in the mounting portion 14A, and the feeding pin 312 arranged at the bottom of the first coupling circuit sheet 31 extends out of the first mounting portion 14A.

The first fixing portion cooperate with the second fixing portion to mount the radiating sheet 12 to the insulating bracket 13, and the feeding network circuit board 1 includes a second assembling portion and a feeding network 3. The second assembling portion fixedly cooperate with the first assembling portion to mount the insulating bracket 13 to the feeding network circuit board 1, and the feeding network 3 is electrically connected to the feeding pin to feed a signal.

As shown in FIG. 2, in a first embodiment where the radiating sheet is connected to the insulating bracket, the first fixing portions comprise four first fixing portions corresponding to the four bosses, and each of the four first fixing portions includes a first rectangular spring corner 121 and a second rectangular spring corner 122. The first rectangular spring corner 121 and the second rectangular spring corner 122 are manufactured by a wire cutting or stamping process. The first rectangular spring corner 121 includes a connecting end and an elastic free end, the connecting end and the radiating sheet are connected into one piece, and the elastic free end has a rectangular shape. The second rectangular spring corner 122 has a same structure as the first rectangular spring corner, and a difference therebetween is that the elastic free end of the second rectangular spring corner 122 is opposite to the elastic free end of the first rectangular spring corner 121. Each boss is inserted between the first rectangular spring corner 121 and the second rectangular spring corner 122 that are opposite to each other in such a manner that the first rectangular spring corner 121 and the second rectangular spring corner 122 generate an elastic deformation force and are reversely snap jointed and fixed to a corresponding boss. The radiating sheet 12 and the insulating bracket 13 use engagement of the rectangular spring corner of the radiating sheet and the boss of the insulating bracket 13, to achieve fixing of the radiating sheet 12.

Figure 6:
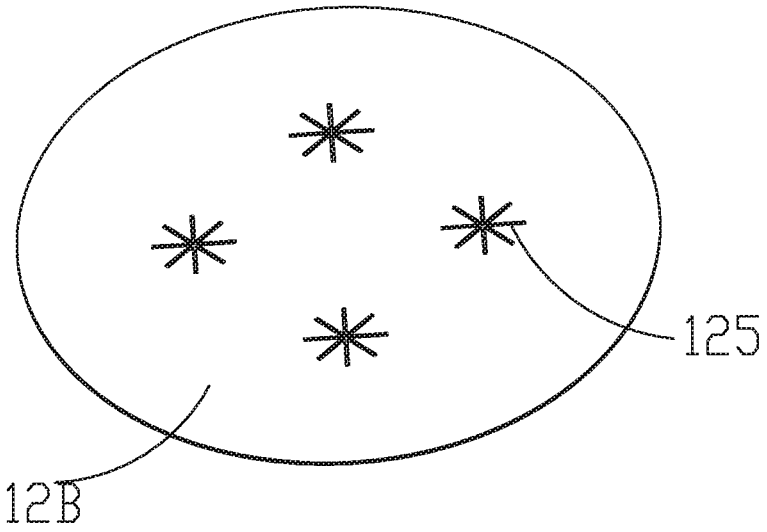
FIG. 6 is schematic diagram of a second embodiment of a radiating sheet of an antenna system.

As shown in FIG. 6, in a second embodiment where the radiating sheet is connected to the insulating bracket 13, the first fixing portions include four first fixing portions corresponding to the bosses, and each first fixing portion includes a plurality of acute-angled spring corners 125. In an embodiment, the plurality of the acute-angled spring corners is firmed on the radiating sheet 12B by using a cross line cutting or stamping process, and a plug-slot is formed by cutting at a center. Eight spring corners with free ends having acute angles are formed, and the free ends of the eight acute-angled spring corners are arranged around the plug-slot located at the center. In an assembly process, the eight acute-angled spring corners can generate eight uniformly distributed focus points around the boss of the insulating bracket 13, making the assembly of the radiating sheet and the insulating bracket more stable. Each boss is inserted between the plurality of the acute-angled spring corners 125 in such a manner that the plurality of the acute-angled spring corners 125 generates elastic deformation force and are snap jointed and fixed to corresponding bosses. The radiating sheet 12B and the insulating bracket 13 utilize engagement of the acute-angled spring corner 125 on the radiating sheet and the boss of the insulating bracket 13, to fix the radiating sheet 12B.

When assembling the insulating bracket, the first positioning post 1321 is pre-positioned in the first positioning hole, the second positioning post 1322 is pre-positioned in the second positioning hole, and the insulating bracket 13 is pressed in such a manner that the first snap joint 1331 can be fixedly connected in the first snap groove and the second snap joint 1332 can be fixedly connected in the second snap groove.

The slide rail formed on each mounting portion includes a first slide rail 141 and a second slide rail 142.

Figure 4:
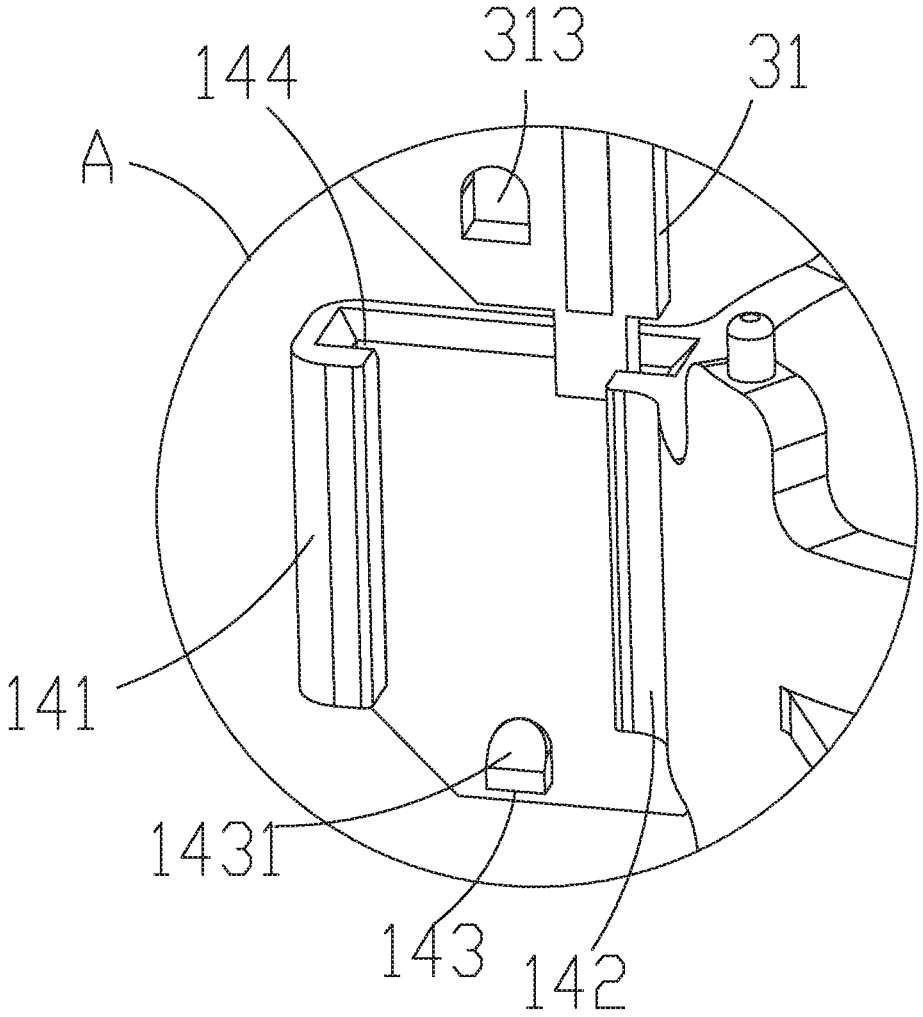
FIG. 4 is an enlarged schematic diagram of an A portion of an antenna system.

Referring to the partially enlarged diagram shown in FIG. 4, the first mounting portion 14A includes a body, the first slide rail 141 and the second slide rail 142 are formed on two sides of the body. The body is provided with an oblique boss 143 located on a side where the slide rail is provided, and the body is also provided with a reinforcing rib on another side thereof. Similarly, the second mounting portion 14B is provided with a second reinforcing rib, the third mounting portion 14C is provided with a third reinforcing rib 15C, and the fourth mounting portion 14D is provided with a fourth reinforcing rib 15D.

In an embodiment, the oblique boss 143 is provided with a guiding oblique surface 1431, which facilitates the corresponding coupling circuit sheet to smoothly and quickly slide into the fixing hole 313.

The first coupling circuit sheet 31 is capable of sliding into the first slide rail 141 and the second slide rail 142 of the first mounting portion 14A until the oblique boss 143 slides into the fixing hole 313.

In the connection of the feeding network, the plurality of the coupling circuit sheets includes four coupling circuit sheets, the feeding network circuit board 1 is provided with four polarization power division lines, the polarization direction of the four polarization power division lines is +45 degrees or −45 degrees, and the connection terminals of the four polarization power division lines are respectively welded to the feeding pins of the corresponding coupling circuit sheets.

In an embodiment, in order to increase strength of the bracket structure while simplifying the assembly process, the insulating bracket 13 made is formed into one piece by a plastic injection molding process, the radiating sheet 12 and the radiating sheet 12B are square or circular metal sheets, and thicknesses of the radiating sheet 12 and the radiating sheet 12B each are smaller than 0.2 mm.

During production and assembly, the four coupling circuit sheets respectively slide into the first slide rail 141 and the second slide rail 142 of the corresponding mounting portion, until the corresponding oblique boss 143 slides into the fixing hole, and the feeding pin located at the bottom of the coupling circuit sheet extends out of the mounting portion. Then the insulating bracket 13 is directly inserted in the feeding network circuit board 1, and the first positioning post 1321 and the second positioning post 1322 that are located at the bottom of the insulating bracket 13 are cooperated with the first positioning hole and the second positioning hole of the feeding network circuit board 1 to realize pre-fixing of the insulating bracket 13. The insulating bracket 13 is firmly pressed, such that the first snap joint 1331 and the second snap joint 1332 that are located at the bottom of the insulating bracket 13 are fixedly connected in the first snap groove and the second snap groove of the feeding network circuit board 1, respectively. Next, the feeding pins of the four coupling circuit sheets are respectively welded to the connection terminals of the four polarization power division lines having the polarization directions of +45 degrees and −45 degrees on the feeding network circuit board 1 to realize the feeding connection. Finally, the four bosses on the top of the insulating bracket 13 are inserted into the plurality of the rectangular spring corners or the acute-angled spring corners of the radiating sheet 12 and the radiating sheet 12B, to complete the assembly of one of the antenna systems 2.

Figure 7:
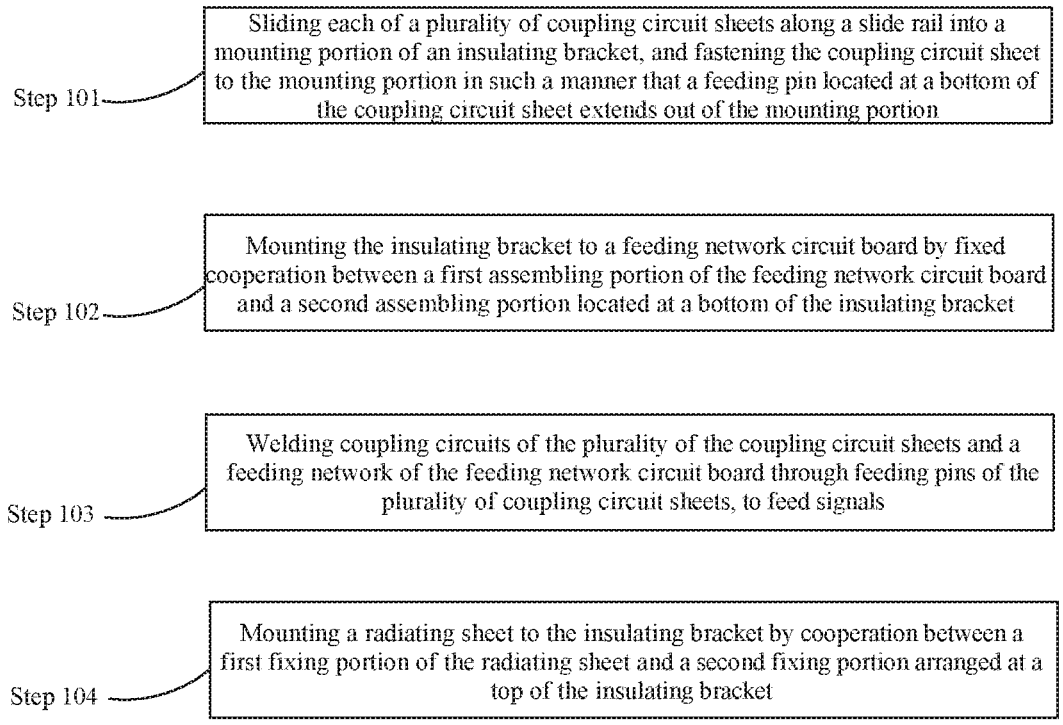
FIG. 7 is a flowchart of an assembly method of an antenna system.

Referring to FIG. 7, a flowchart of an assembly method of the antenna system of the present embodiment is shown.

The assembly method of the antenna system mainly includes following steps.

At step 101, each of a plurality of coupling circuit sheets is slid along a slide rail into a mounting portion of the insulating bracket 13 and fastened to the mounting portion in such a manner that a feeding pin located at a bottom of each of a plurality of coupling circuit sheets extends out of the mounting portion. The slide rail includes a first slide rail and a second slide rail, and two sides of each coupling circuit sheet slide into the mounting portion under guidance of the first slide rail and the second slide rail.

At step 102, the insulating bracket 13 is mounted to the feeding network circuit board 1 by fixed cooperation between a first assembling portion of the feeding network circuit board 1 and a second assembling portion located at the bottom of the insulating bracket.

At step 103, coupling circuits of the plurality of the coupling circuit sheets and the feeding network 3 of the feeding network circuit board 1 are welded through the feeding pins to feed signals.

At step 104, the radiating sheet is mounted to the insulating bracket 13 by cooperation between a first fixing portion of the radiating sheet and a second fixing portion located at a top of the insulating bracket 13.

In an embodiment, the radiating sheet can be the radiating sheet 12 shown in FIG. 2, or the radiating sheet 12B shown in FIG. 6.

In the antenna system, the base-station array antenna, and the assembly method of the antenna system of the present embodiment, the feeding structure adopts the coupling circuit sheets of small-sized circuit boards having the same structure, to reduce the weight of each antenna system. Moreover, the antenna system 2 has various one-time fixing structures, for example, the first fixing portion of the radiating sheet can be mounted to the second fixing portion located on the top of the insulating bracket 13 at one time. In an embodiment, the first fixing portion can be rectangular or a plurality of sawtooth spring corners, and it can be directly plug-connected to the second fixing portion of the insulating bracket 13. In another example, the second assembling portion of the feeding network circuit board 1 and the first assembling portion of the insulating bracket 13 are also one-time fixing structures that can be completely assembled just by one operation, so that the assembly is simple in order to improve the assembly efficiency of the antenna system.

In the antenna system, the base-station array antenna, and the assembly method of the antenna system of the present embodiment, each coupling circuit sheet is stably supported on the insulating bracket 13 through the corresponding mounting portion and then connected to the feeding network circuit board 1 at one operation, such that the subsequent welding operation has a better effect in order to ensure product stability; moreover, the feeding welding points are only used to connect the coupling circuit sheet, and there are few feeding welding points. In the antenna system, the base-station array antenna, and the assembly method of the antenna system of the present embodiment, the multiple mounting portions are evenly distributed on the bracket body along the circumference of the bracket body to obtain better polarization performance. The antenna system of the present embodiment can be pre-installed on the feeding network circuit board 1 stably through cooperating between the first assembling portion and the second assembling portion, such that it is suitable for subsequent automatic production and processing with relatively high assembly accuracy, and in practice, the antenna system 2 is suitable for manufacturing 5G large-scale array antennas.

In addition, in the antenna system, the base-station array antenna, and the assembly method of the antenna system of the present embodiment, the radiating sheet 12 of the antenna system 2 is made of a stainless-steel sheet, the insulating bracket 13 is made of engineering plastic, the coupling circuit sheet is a small-sized metal sheet, and an overall design can reduce the weight of the antenna system and reduce manufacturing cost of the antenna. In addition, multiple components between the antenna system and the feeding network circuit board 1 of the present embodiment are each one time fixing structures, and there are only four necessary feeding welding points, the welding points are few, it is easy for automatic production and assembly, an assembly error is small, and the consistency of the antenna performance is good; the entire antenna system is light in weight, low in cost, and highly automated.

The above is only the embodiments of the present invention and does not limit the patent scope of the present invention. Any equivalent structure or equivalent process transformation made by using the description and the accompany drawings of the present invention, or those directly or indirectly used in other related technical fields, are also included in the scope of protection of the present invention.

What is claimed is:

1. An antenna system, comprising:

a radiating sheet provided with at least one first fixing portion that is elastic;

an insulating bracket comprising a bracket body, and a plurality of mounting portions, at least one second fixing portion and at least one first assembling portion that are provided on the bracket body, wherein the at least one second fixing portion is provided at a top of the bracket body, and the at least one first assembling portion is provided at a bottom of the bracket body;

a plurality of coupling circuit sheets, wherein each of the plurality of coupling circuit sheets is provided with a coupling circuit at a single side thereof and is fixed in a slide rail of one mounting portion of the plurality of mounting portions in such a manner that a feeding pin located at a bottom of the coupling circuit sheet extends out of the one mounting portion; and a feeding network circuit board comprising at least one second assembling portion and a feeding network, wherein the at least one first fixing portion and the at least one second fixing portion cooperate with each other in such a manner that the radiating sheet is mounted to the insulating bracket, the at least one second assembling portion and the at least one first assembling portion fixedly cooperate with each other in such a manner that the insulating bracket is mounted to the feeding network circuit board, and the feeding network is electrically connected to the feeding pin to feed a signal.

2. The antenna system as described in claim 1, wherein the bracket body is an annular bracket body, the plurality of the mounting portions is evenly distributed along a circumference of the bracket body, the top of the bracket body extends upward to form two pairs of top connecting tabs, the bottom of the bracket body extends downward to form two pairs of bottom connecting tabs, the at least one second fixing portion comprises four bosses, and each of the four bosses is disposed on one top connecting tab of the two pairs of top connecting tabs; the at least one first assembling portion comprises a first positioning post, a second positioning post, a first snap joint and a second snap joint, the first positioning post and the second positioning post are arranged on a group of opposite bottom connecting tabs of the two pairs of bottom connecting tabs, respectively, and the first snap joint and the second snap joint are arranged on another group of opposite bottom connecting tabs of the two pairs of bottom connecting tabs, respectively.

3. The antenna system as described in claim 2, wherein the at least one first fixing portion comprises four first fixing portions corresponding to the four bosses, each of the four first fixing portions comprises a first rectangular spring corner and a second rectangular spring corner, and each of the four bosses is inserted between the first rectangular spring corner and the second rectangular spring corner that are opposite to each other in such a manner that each of the first rectangular spring corner and the second rectangular spring corner generates an elastic deformation force and is snap jointed and fixed to one of the four bosses.

4. The antenna system as described in claim 2, wherein the at least one first fixing portion comprises four first fixing portions corresponding to the four bosses, each of the four first fixing portions comprises a plurality of acute-angled spring corners, and each of the four bosses is inserted between the plurality of the acute-angled spring corners of one of the four first fixing portions in such a manner that the plurality of the acute-angled spring corners generates an elastic deformation force and is snap jointed and fixed to one of the four bosses.

5. The antenna system as described in claim 2, wherein the at least one second assembling portion comprises a first positioning hole, a second positioning hole, a first snap groove and a second snap groove that are provided in the feeding network circuit board; and in an assembly process, the first positioning post is pre-positioned in the first positioning hole, the second positioning post is pre-positioned in the second positioning hole, and the insulating bracket is pressed in such a manner that the first snap joint is connected in the first snap groove and the second snap joint is connected in the second snap groove.

6. The antenna system as described in claim 1, wherein each of the plurality of coupling circuit sheets is a PCB circuit board that is coated with copper on a single surface thereof; each of the plurality of coupling circuit sheets comprises a base layer and a circuit layer, and the coupling circuit is provided in the circuit layer; and each of the plurality of coupling circuit sheets is provided with a fixing hole at a side thereof close to the feeding pin; the plurality of mounting portions comprises four mounting portions, the slide rail comprises a first slide rail and a second slide rail, each of the plurality of mounting portions comprises a body, the first slide rail and the second slide rail are formed on two sides of the body, the body is provided with an oblique boss on a side of the body where the slide rail is provided, the body is provided with a reinforcing rib on another side thereof, and each of the plurality of coupling circuit sheets is capable of sliding into the first slide rail and the second slide rail of one mounting portion of the four mounting portions until the oblique boss of the one mounting portion slides into the fixing hole of the coupling circuit sheet.

7. The antenna system as described in claim 1, wherein the plurality of coupling circuit sheets comprises four coupling circuit sheets, four polarization power division lines are provided on the feeding network circuit board, a polarization direction of each of the four polarization power division lines is of +45 degrees or −45 degrees, and connection terminals of the four polarization power division lines are respectively welded to feeding pins of the four coupling circuit sheets.

8. The antenna system as described in claim 1, wherein the insulating bracket is formed into one piece by a plastic injection molding process, and the radiating sheet is a square or circular metal sheet and has a thickness smaller than 0.2 mm.

9. A base station array antenna, comprising:

a feeding network circuit board; and a plurality of antenna systems welded on the feeding network circuit board, wherein each of the plurality of antenna systems comprises:

a radiating sheet provided with at least one first fixing portion that is elastic;

an insulating bracket comprising a bracket body, and a plurality of mounting portions, at least one second fixing portion and at least one first assembling portion that are provided on the bracket body, wherein the at least one second fixing portion is provided at a top of the bracket body, and the at least one first assembling portion is provided at a bottom of the bracket body; and a plurality of coupling circuit sheets, wherein each of the plurality of coupling circuit sheets is provided with a coupling circuit at a single side thereof and is fixed in a slide rail of one mounting portion of the plurality of mounting portions in such a manner that a feeding pin located at a bottom of the coupling circuit sheet extends out of the one mounting portion;

wherein the feeding network circuit board comprises at least one second assembling portion and a feeding network, the at least one first fixing portion and the at least one second fixing portion cooperate with each other in such a manner that the radiating sheet is mounted to the insulating bracket, the at least one second assembling portion and the at least one first assembling portion fixedly cooperate with each other in such a manner that the insulating bracket is mounted to the feeding network circuit board, and the feeding network is electrically connected to the feeding pin to feed a signal.

10. An assembling method of an antenna system, comprising:

sliding each of a plurality of coupling circuit sheets along a slide rail into a mounting portion of an insulating bracket, and fastening the coupling circuit sheet to the mounting portion in such a manner that a feeding pin located at a bottom of the coupling circuit sheet extends out of the mounting portion;

mounting the insulating bracket to a feeding network circuit board by fixed cooperation between a first assembling portion of the feeding network circuit board and a second assembling portion located at a bottom of the insulating bracket;

welding coupling circuits of the plurality of the coupling circuit sheets and a feeding network of the feeding network circuit board through feeding pins of the plurality of coupling circuit sheets, to feed signals; and mounting a radiating sheet to the insulating bracket by cooperation between a first fixing portion of the radiating sheet and a second fixing portion arranged at a top of the insulating bracket.

* * * * *